United States Patent [19]

Niedermeier et al.

[11] Patent Number: 4,963,296

[45] Date of Patent: Oct. 16, 1990

[54] PROCESS FOR THE PREPARATION OF PROPELLANT CHARGE POWDER

[75] Inventors: Günther Niedermeier, Ampfing; Helmut Pausch, Waldkraiburg; Wolfgang Miehling, Mühldorf am Inn; Jürgen Knobloch; Wolfgang Helmich, both of Waldkraiburg, all of Fed. Rep. of Germany

[73] Assignee: WNC-Nitrochemie GmbH, Fed. Rep. of Germany

[21] Appl. No.: 228,921

[22] PCT Filed: Oct. 8, 1987

[86] PCT No.: PCT/EP87/00585

§ 371 Date: Jun. 16, 1988

§ 102(e) Date: Jun. 16, 1988

[87] PCT Pub. No.: WO88/02743

PCT Pub. Date: Apr. 21, 1988

[30] Foreign Application Priority Data

Oct. 16, 1986 [DE] Fed. Rep. of Germany ..... 3635296

[51] Int. Cl.[5] ..... C06B 21/00; D03D 23/00; D03D 43/00; F42B 3/00

[52] U.S. Cl. ..... 264/3.2; 86/20.1; 86/20.12; 149/109.6; 264/3.1; 264/3.3

[58] Field of Search ..... 149/109.6, 46; 100/95; 102/285, 288; 264/3.2, 3.3, 3.1; 241/27, 221, 222, 229, 236; 86/20.1, 20.12; 366/73, 76; 425/201

[56] References Cited

U.S. PATENT DOCUMENTS

| | | | |
|---|---|---|---|
| 2,384,521 | 9/1945 | Andersen et al. | 18/55 |
| 2,874,604 | 2/1959 | Diels et al. | 86/1.1 |
| 3,298,215 | 1/1967 | Bonhoff | 264/3.2 |
| 3,354,010 | 11/1967 | Hopper et al. | 149/18 |
| 3,548,742 | 12/1970 | Seufert et al. | 241/236 |
| 3,731,584 | 5/1973 | Gilbert | 86/1.1 |
| 3,928,514 | 12/1975 | Brachert et al. | 264/3.1 |
| 4,051,207 | 9/1977 | Brachert et al. | 264/3.3 |
| 4,120,920 | 10/1978 | Cougoul et al. | 264/3.1 |
| 4,605,309 | 8/1986 | Alberts | 366/76 |

FOREIGN PATENT DOCUMENTS

| | | |
|---|---|---|
| 0148966 | 12/1970 | European Pat. Off. . |
| 1596363 | 6/1970 | France . |
| 2295932 | 7/1976 | France . |
| 317908 | 1/1957 | Switzerland . |
| 391281 | 8/1965 | Switzerland . |
| 838865 | 6/1960 | United Kingdom . |
| 2047674 | 12/1980 | United Kingdom . |

*Primary Examiner*—Howard J. Locker

*Attorney, Agent, or Firm*—Lowe, Price, LeBlanc, Becker & Shur

[57] ABSTRACT

A process is provided for the preparation of dibasic propellant charge powder by a solvent-free process, in which a continuous flow of raw powder mixture moist with water is kneaded at an elevated temperature in a set of shearing rollers, to which the raw powder mixture is continuously supplied and at one end of which the gelatinized mass is continuously removed and immediately continuously granulated. The resulting granulate is continuously delivered to an extruder by means of which it is moulded into powder strands which are worked up into the finished powder by cutting and an end treatment. The process requires only small quantities of powder within the kneading equipment and thus provides a safe and efficient continuous manufacturing facility.

11 Claims, 1 Drawing Sheet

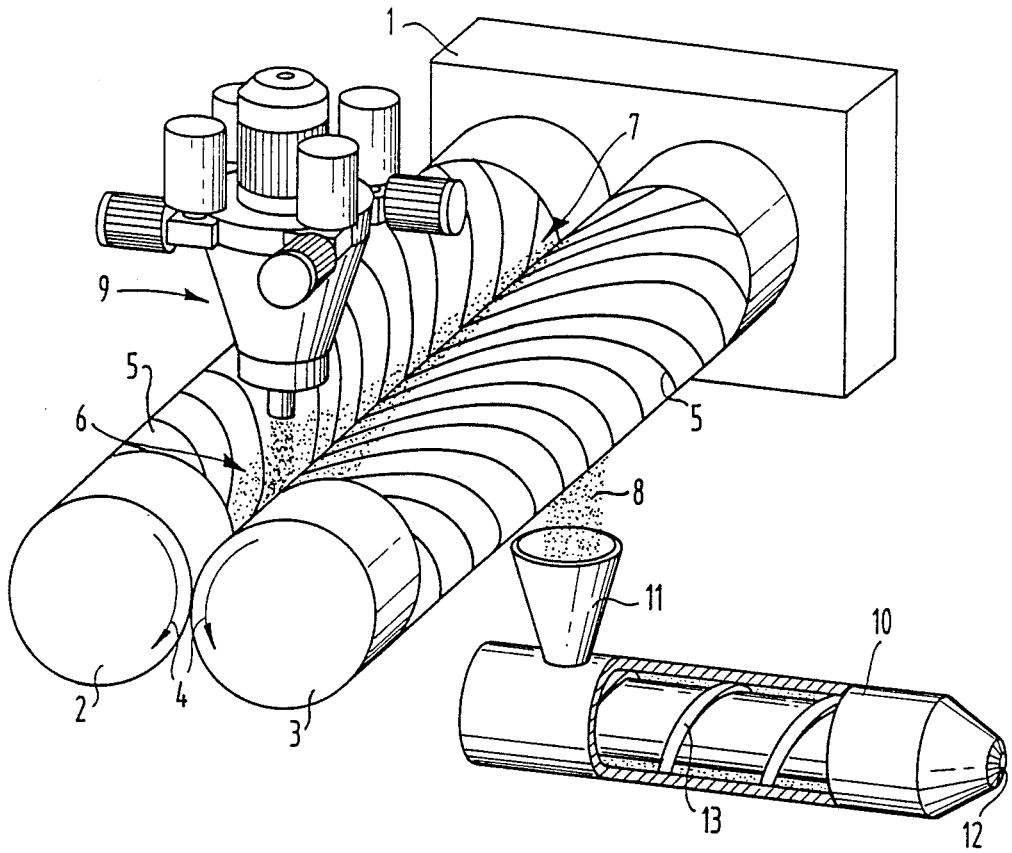
1
7
9
5
6
5
8
11
10
2
4
3
13
12

PROCESS FOR THE PREPARATION OF PROPELLANT CHARGE POWDER

TECHNICAL FIELD OF THE INVENTION

This invention relates to a process for the preparation of propellant charge powder, in particular of dibasic POL powder from a raw powder mixture moistened with water.

BACKGROUND OF THE INVENTION

In known processes for the preparation of propellant charge powders such as a dibasic POL powder from a moist raw powder, raw powder mixture is cutomarily kneaded by means of calander rollers for the purpose of homogenizing and gelatinizing or plasticizing the mixture but this can only be carried out batch-wise, not continuously. A sheet is typically formed on one of the two rollers of the calander, and this sheet must be kneaded to completion and then completely removed before a fressh batch of powder mixture can be introduced.

It is also known to carry out the kneading process continuously by means of an extruder containing kneading elements. In that case, the kneading process may be immediately followed by the moulding process within the same extruder without a break. This means that the raw powder mixture is directly converted into powder strands. It is, however, difficult to feed the correct amount of raw material into the extruder, especially if the material is made moist with water, and an even more critical difficulty is that when the powder mass is kneaded in the extruder, it is subjected to a considerable amount of heat and mechanical stress inside a closed space. This constitutes a considerable safety risk and if spontaneous ignition occurs, this inevitably results in an explosion.

DISCLOSURE OF THE INVENTION

It is an object of the present invention to provide a process for continuous and safe production of a propellant charge.

In the process according to this invention, an open set of cooperating paired shearing rollers of known kind is used for kneading powder. The kneading process takes place continuously on these rollers. The raw powder mixture is continuously introduced near one end of the shearing rollers and is gradually transported to the other end of these rollers in the course of kneading. A sheet is formed on one of the two rollers of the set and this sheet may be continuously removed at the other end, e.g., by continuously cutting off a strip of the sheet. Since the set of shearing rollers is open, spotaneous ignition of the powder mixture can at worst result in burning of the sheet but not in an explosion. The difficulties of dosing the how rate of powder mixture supplied to the shearing rollers, especially when the mixture is moistened with water, are eliminated, while the kneading process is made continuous. This enables the rollers to be operated and observed from a distance so that the safety of processing the material is considerably enhanced. Lastly, the removal of water from the raw mixture kneaded in the set of open rollers does not give rise to any difficulties, in contrast to the process of kneading in a closed extruder. The granulating process may preferably carried out immediately after the kneading process, for example by punching granulate out of the sheet by means of a granulating head as the sheet leaves the rollers at the discharge end, and then removing the granulate.

For moulding the granulate, an extruder is advantageously used in combination with the process according to this invention. The granulate may be continuously introduced into the extruder as it is formed. The entire production process from introduction of the raw powder mixture to formation of the powder strands is then completely continuous. Kneading can subject the powder mixture to severe heating and mechanical stress, but is not required and should not occur, in the extruder used for the moulding process, hence no particular safety problems are encountered. It is particularly advantageous that the granulate can be directly transferred from the shearing rollers to the extruders as it is formed and while it is still hot. Long heating zones are therefore not required in the extruder, also a very short extruder may be used. The quantity of propellant charge powder enclosed in the extruder is then correpondingly small, and this is an advantage for safety reasons. The energy costs required for heating the extruder are correspondingly reduced. Lastly, there is the advantage that when powder is at an elevated temperature it is more plastic and more readily deformed under a mechanical load. The powder, being heated, therefore entails less risk of deflagration under the mechanical stress to which it is subjected in the extruder.

If the powder is prepared by the so called semisolvent process, solvent will be added to the hot granulate from the shearing rollers in the extruder during the process. For the preparation of tribasic powder, nitroguanidine will also be added at this point. The granulate is made up into a paste with the solvent, and the nitroguanidine is incorporated into this paste.

It is advisable, especially when using an extruder for moulding the process powder, to carry out the process on the shearing rollers in such a manner that the gelatinized sheet is practically dry when removed therefrom. Not only is the process of granulation then very simple to carry out but also problems in charging the extruder are avoided and removing the water from the extruder.

As gelatinization of the raw powder mixture on the shearing rollers progresses, the sheet progressively adheres more firmly to one roller and transport of the sheet along the rollers becomes more difficult. This effect is countered by lowering the temperature at the rollers as this reduces the adherence of the sheet to the roller and, therefore, increases the speed of transport. An axial temperature gradient along the roller may be held at up to 40° C. for this purpose.

Summarizing, the teaching according to the invention enables propellant charge powder to be provided under virtually ideal conditions. The process may be carried out completely continuously and can be controlled and observed from a distance, is far safer than average, in part because only a relatively small quantity of product is on the shearing rollers at any one time. This results in a powder of exceptionaly high quality, especially as regards its stability.

The process according to this invention and further advantageous details thereof are described in more detail below with reference to a drawing.

BRIEF DESCRIPTION OF THE DRAWING

FIG. 1 is a schematic perspective view illustrating apparatus for practicing the process according to a preferred embodiment of this invention.

DESCRIPTION OF THE PREFERRED EMBODIMENTS

The set of shearing rollers 1 comprises two rollers 2 and 3. placed horizontally side by side and driven to rotate in opposite directions as indicated by the arrows 4. Each of the roller 2 and 3 has its own drive means suitable for continuous operation, with infinitely adjustable speed control so that the rollers can operate with friction over the whole range of speeds of rotation. Hydrostatic drives are used for the region which is at risk from explosions.

The roller 2 which is situated at the rear in the drawing is adjusted in its position relative to the front roller 3 by hydraulic means. The nip between the rollers may be adjusted to a width of from 0.5 to 5 mm by displacement of the front roller 3. Both rollers 2 and 3 may be heated to a temperature of from 20° C. to 120° C. by means of internal heating means of known kind.

Each of the rollers 2 and 3 has spiral shearing grooves 5 which have a product-specific geometry with regard to the width, depth, pitch angle and number of grooves. The shearing grooves 5 are so positioned that the treated product is continuously transported from the input end 6 situated at the front in FIG. 1 to the discharge end 7 situated at the rear.

A controlled flow of raw moistened with water and having a moisture, content of about 30% is delivered to the shearing rollers 2 and 3 from a supply apparatus 9 above the input end 6 to produce, for example, a dibasic POL powder. In this part of the rollers, the raw powder mixture is kneaded in the nip between the rollers. A sheet of raw powder mixture forms on the front roller 3 to extend over the whole length of the roller. The two rollers are kept at an elevated temperature by the heat means. A reserve of kneaded product collects over the nip between the rollers and same of the moisture is expressed, i.e., squeezed out; from this product. Owing to the intensive kneading and transport action of the shearing rollers 2, 3, the onset of gelatinization which imparts a greyish white colour to the powder mixture can be observed by the time the sheet has travelled along about one-third of the length of the roller. After two-thirds of the length of the roller, the colour of the sheet has already turned dark grey. At the discharge end 7, the sheet is already completely gelatinized and is transparent and black. The temperature, the width of the nip between the rollers and hence also the pressure in the nip and the speeds of rotation of the two rollers 2 and 3 are chosen so that the gelainized powder sheet still has a residual moisture content of about 1% at the discharge end.

The temperature of the two rollers is typically in the region of 70° C. to 110° C. The rear roller is kept at a temperature which is a few degrees lower than that of the front roller, in order that the sheet of kneaded material tends to adhere to the cooler front roller. Heating of the rollers is advantageously carried out in such a manner that a temperature gradient is produced in the axial direction, with the temperature decreasing towards the discharge end 7. The temperature difference between the input end 6 and discharge end 7 is so chosen that the sheet will be transported at a substantially uniform speed.

A typical value for the temperature difference is 30° C. The speed of rotation of the rollers should be from 30 to 70 r.p.m., with the cooler front roller, which carries the sheet, rotating at a higher speed. The pitch of the shearing grooves 5 may suitably form an angle of 30° to 60° with the roller axis. The pitch of the shearing grooves need not be constant over the entire length of each roller but may advantageously be lower near the input end 6 than near the discharge end 7, so that the sheet stays for a relatively longer time behind the input end to enable the water to be throughly squeezed out. The depth of the shearing grooves may be varied from 0.4 to 2.5 mm. The overall residence time of the raw powder mixture on the shearing rollers should be from 3 to 8 minutes.

The front roller should have a predetermined surface roughness, selected in a particular application to assist in the adherence of the sheet to this roller. This surface roughness may be achieved by coating the surface of the roller or by roughening it. It has been found advantageous to deliberately roughen the front roller to a rougher finish than that conventionally applied to calander rollers used for the manufacture of powder. This roughening may be carried out, for example, by applying a 1-3 N hydrochloric acid to the surface of the roller at 50° to 100° C. while the roller is slowly rotated. When the hydrochloric acid has evaporated, the surface of the roller is washed with water. This treatment imparts the required roughness to the surface.

A granulating apparatus (not shown in the figure) is situated underneath the two rollers 2 and 3 at the discharge end 7. The granulating apparatus cooperates with the rollers 2 and 3, so that a flow of gelatized powder mass continuously arrives at the discharge end 7, whereafter it is continuously removed from the roller 3 and granulated in one step.

The granulate 8, while still warm, drops into the feed hopper 11 of an extruder 10 in which it is moulded into powder strands by a die 12. The interior of the extruder 10 contains only a conveyor screw 13 and no kneading elements. The extruder has only been indicated schematically but in practice may consist of a two shaft extruder. The powder strands continuously delivered from the die or shaping nozzle 12 are carried on a conveyor belt (not shown) into a cutting room where they are continuously cut up to form the powder proper which may or may not be subjected to an after treatment. The extruder should have a length of at least 20 cm and should be capable of being heated and cooled.

The rolling mill 1, as described hereinabove, usually carries only 2 to 3 kg of powder mixture. This is very advantageous for safety. In addition, the two rollers 2 and 3 are self cleaning, so that change-over from one product to another can be carried out quickly.

In this diclosure, there are shown and described only the preferred embodiments of the invention, but as aforementioned, it is to be understood that the invention is capable of use in various other combinations and environments and is capable of changes or modifications within the scope of the inventive concept as expressed herein.

We claim:

1. A continuous process for manufacturing a propellant charge powder from a raw powder mixture made moist by water comprising the steps of:

continuously supplying a flow of a water-moistened raw powder mixture to adjacent intake ends of a pair of cooperating shearing rollers defining a nip of adjustable width, each roller having its own drive with infinitely adjustable speed of rotation;

homogenizing and gelatinizing the water-moistened raw powder mixture, while controllably expressing water therefrom, by kneading the same at a predetermined elevated temperature using said shearing rollers, to produce a homogenous gelatinized material;

continuously removing said gelatinized material from discharge ends of said shearing rollers opposite said intake ends thereof while selecting the width of the nip and the speed of rotation of said shearing rollers so that said material, removed from said rollers after said gelatinizing step, has a residual moisture content of less than three-percent by weight;

continuously granulating said gelatinized material removed from said shearing rollers, to produce a granulate;

extruding said granulate by an extruder operating without a kneading action to mold said granulate into powder strands;

continuously cutting said powder strands into predetermined lengths to form the powder proper.

2. A process for manufacturing a propellant charge powder in accordance with claim 1, wherein:

a residual water content of said mixture after said gelatinizing step is substantially equal to one-percent by weight.

3. A process for manufacturing a propellant charge powder in accordance with claim 1, comprising the further step of:

heating one of said shearing rollers to produce a temperature gradient in an axial direction of said shearing rollers that decreases toward said discharge end of said rollers.

4. A process for manufacturing a propellant charge powder in accordance with claim 1, wherein:

said granulate is transferred to said extruder while said granulate is substantially at said predetermined elevated temperature.

5. A process for manufacturing a propellant charge powder in accordance with claim 2, wherein:

said granulate is transferred to said extruder while said granulate is substantially at said predetermined elevated temperature.

6. A process for manufacturing a propellant charge powder in accordance with claim 5, comprising the further step of:

heating said shearing rollers to produce a temperature gradient in an axial direction of said shearing rollers such that the temperature decreases from the intake ends toward the discharge ends of the rollers.

7. A process for manufacturing a propellant charge powder in accordance with claim 1, wherein:

said water-moistened raw power mixture supplied to the shearing rollers has an initial moisture content of approximately 30% by weight.

8. A process for manufacturing a propellant charge powder in accordance with claim 1, wherein:

each of said pair of shearing rollers is maintained at a temperature in the range 20° C. to 120° C.

9. A process for manufacturing a propellant charge powder in accordance with claim 8, wherein:

the an axial temperature difference between the intake and the discharge ends of the rollers is approximately 30° C.

10. A processs for manufacturing a propellant charge powder in accordance with claim 1, wherein:

one of said pair of shearing rollers is provided with a roughened surface to facilitate adherence threat of the water-moistened raw powder mixture being kneaded between the pair of shearing rollers.

11. A process for manufacturing a propellant charge powder in accordance with claim 7, wherein:

a residual water content of said mixture after said gelatinizing step is substantially equal to one-percent by weight.

* * * * *